US006393886B1

(12) United States Patent
Bagusche

(10) Patent No.: US 6,393,886 B1
(45) Date of Patent: May 28, 2002

(54) LATERALLY FLOATING ROLLER CAGE

(75) Inventor: Siegfried Bagusche, Erkelenz (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 0 days.

(21) Appl. No.: 09/747,867

(22) Filed: Dec. 22, 2000

(30) Foreign Application Priority Data

Sep. 8, 2000 (DE) ..... 100 44 378

(51) Int. Cl.[7] ..... B21D 15/00
(52) U.S. Cl. ..... 72/110; 72/107
(58) Field of Search ..... 72/107, 110; 29/6.01

(56) References Cited

U.S. PATENT DOCUMENTS 4,693,105 A * 9/1987 Lee, Jr. ..... 72/110
6,253,590 B1 * 7/2001 Lonero et al. ..... 72/110
6,257,037 B1 * 7/2001 Lonero et al. ..... 72/110

* cited by examiner

*Primary Examiner*—Ed Tolan
(74) *Attorney, Agent, or Firm*—Carlson, Gaskey & Olds

(57) ABSTRACT

A roller cage (4) is provided for the guidance of a minimum of one work roller (2) of a tool for deep rolling of radii or grooves on crankshaft journals or crank pins, where the roller cage (4) is supported at the end (8) of the long leg (9) of an L-shaped tool holder, and is loosely guided in the longitudinal direction of the long leg (9) in a tab engaging in a longitudinal groove on the underside (13) of the roller cage (4) from the end (8) of the long leg (9). The longitudinal groove of the roller cage (4) has a considerably greater width than the width of the tab.

9 Claims, 2 Drawing Sheets

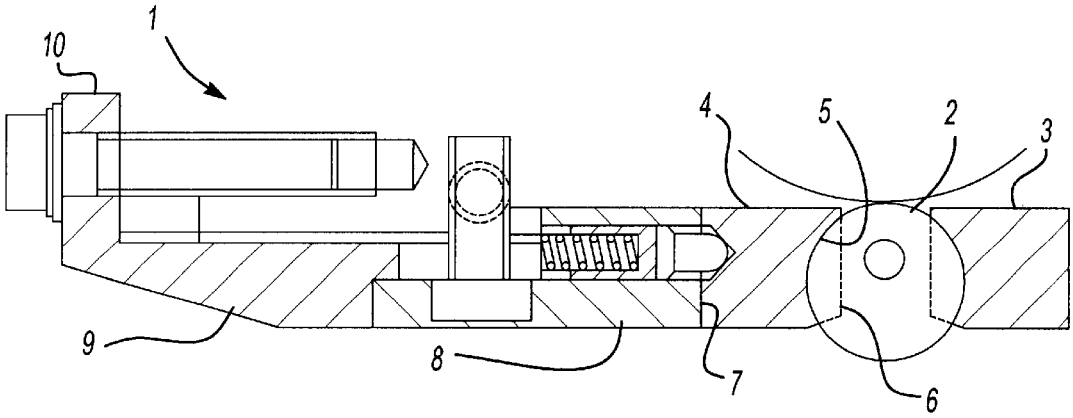
Fig-1
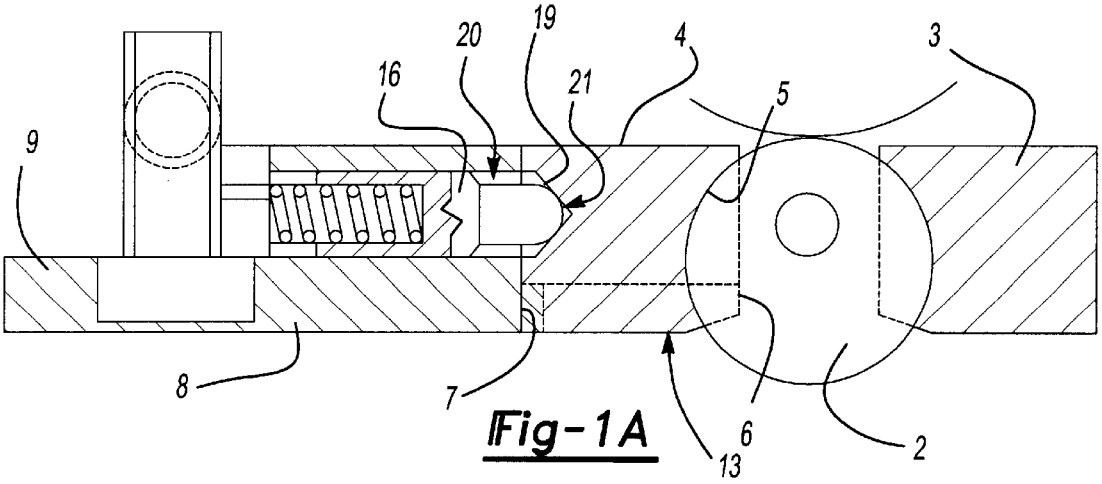
Fig-1A
Fig-2
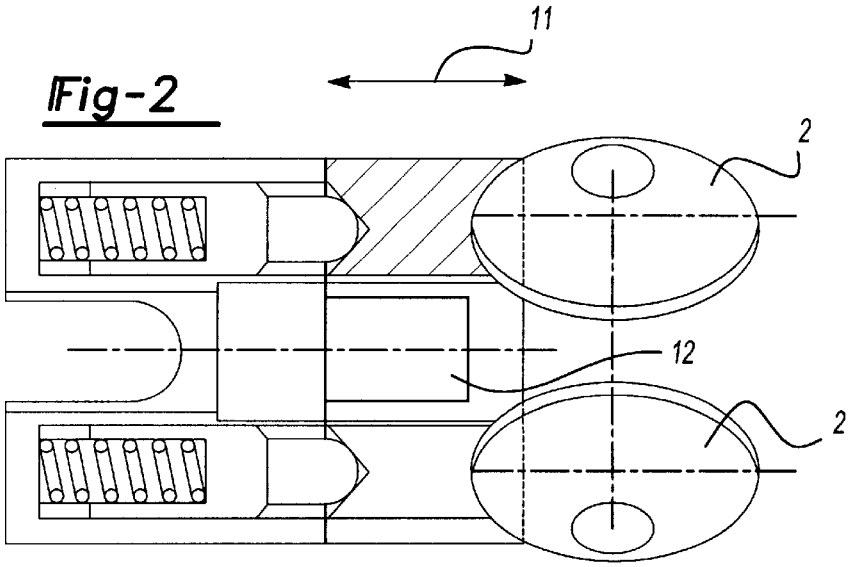

LATERALLY FLOATING ROLLER CAGE

RELATED APPLICATIONS

This application claims priority to German patent application no. 10044378.8, filed Sep. 7, 2000.

BACKGROUND OF THE INVENTION

The invention concerns a roller cage for guiding a minimum of one work roller of a tool for deep rolling of radii or grooves of crankshaft journals or crank pins, where the roller cage is supported at the end of the long leg of an L-shaped tool holder, and loosely guided in the longitudinal direction of the long leg by means of a tab which engages in a longitudinal groove on the underside of the roller cage from the end of the long leg.

A deep rolling tool is described in European Patent Application EP 0 839 607 A1. This known tool is designed for deep rolling of radii or grooves of crankshaft journals or crank pins. Deep rolling is implemented using deep rolling work rollers which are pressed with a specific force into the radii or grooves of crankshaft bearings while the crankshaft rotates. The work rollers are guided in so-called roller cages of prismatic shape and supported at the end of the long leg of an L-shaped tool holder. The guidance is of a floating nature and has a tab projecting from the end of the long leg that engages in a groove on the underside of the roller cage. The floating connection is configured in a way to provide the roller cage, and thereby the work roller, with a limited movement in the axial direction, i.e., in the longitudinal direction of the long leg of the L-shaped tool holder.

Crankshafts will, however, have processing tolerances. These may be of the kind where the spacing between radii or grooves of one and the same bearing differs from that of other bearings. Also, a crankshaft may have differences in length with respect to the location of bearings in the crankshaft axial direction.

Generally, bearings of a crankshaft used in engines of motor vehicles, are deep rolled on a deep rolling machine simultaneously in one operation. To this end a plurality of deep rolling tools are arranged in the deep rolling machine side by side having lateral distances equal to the distances of the crankshaft bearings. Due to process related variations in length between the individual bearings, which may have a magnitude of a few millimeters, the fixed configuration of deep rolling tools within the deep rolling machine causes some deep rolling tools to be subjected to more stress than others. This in turn leads to variations in the wear and tear of deep rolling tools. Deep rolling tools are items of high precision which to a certain degree are capable of adjusting to the manufacturing tolerances of the work. For this reason, higher manufacturing tolerances of crankshafts may reduce the tool life requiring a more frequent change of individual, or all, tools of a deep rolling machine.

SUMMARY OF THE INVENTION

The object of the following invention calls for the configuration of a deep rolling tool that enables it to compensate for longitudinal tolerances at the bearings of crankshafts. The respective deep rolling tool must be configured to allow unrestricted compliance with the specified precision during the deep rolling of a crankshaft bearing. In addition the deep rolling tool must be reliable, easy to handle and reasonably priced.

Surprisingly it was found that for compensation of process related tolerances in the longitudinal direction of a crankshaft, it suffices to design a minimum of one of the two roller cages of a deep rolling tool in which the work rollers are guided, with floating capability perpendicular to the working direction. The simplest approach found for this is to provide the longitudinal groove of the roller cage with a substantially greater width than the tab retaining the roller cage to the deep rolling tool. A difference in width between 0.5 and 2.5 mm has shown to be sufficiently large.

It is however even more advantageous to suspend the roller cage at the tool holder in a self-centering fashion, perpendicular to its working direction. To this end, a minimum of one additional element is provided at the end of the long leg of the tool holder, which engages in a recess provided on the face of the roller cage facing the end of the long leg of the tool holder. This element was found to be especially simple when configured as a round pin that is also spherical at its front end with which it engages the respective recess of the roller cage.

A recess in the roller cage, configured in a rather simple manner is obtained by means of a blind hole whose diameter is substantially greater than the diameter of the round pin, and which at its bottom has the shape of a cone. When the pin is supported elastically at the end of the L-shaped leg of the tool holder, the pin centers itself automatically at the cone shaped bottom of the hole representing the recess in the roller cage. This self-centering feature can be even more effective if the pin in the long leg of the L-shaped tool holder is also supported elastically in the axial direction.

For the simplest application one single pin will suffice which engages the roller cage from the end of the long leg of the L-shaped tool holder. It is however more advantageous to allocate one dedicated pin to each work roller guided by the roller cage. Generally, one roller cage serves to guide two work rollers.

Each of the recesses engaged by the ends of the pins, has a greater diameter than the pins themselves in order to assure sufficient flexibility of the roller cage perpendicular to its working direction. As with the differences in width between groove and tab, the diametrical differences have a magnitude between 0.5 and 2.5 mm.

BRIEF DESCRIPTION OF THE DRAWINGS

In the following the invention is described in more detail with reference to one embodiment. The figures, each in full size, show the following:

FIG. 1 a longitudinal cross section through one tool holder and one roller cage, FIG. 1*a* an enlarged partial section of FIG. 1 at twice scale, FIG. 2 a top view of the partial section of FIG. 1, FIG. 2*a* an enlarged view of FIG. 2 at twice scale, and FIG. 3 a front view of roller cage and tool holder of FIG. 1.

DETAILED DESCRIPTION OF THE PREFERRED EMBODIMENTS

Figure 3:
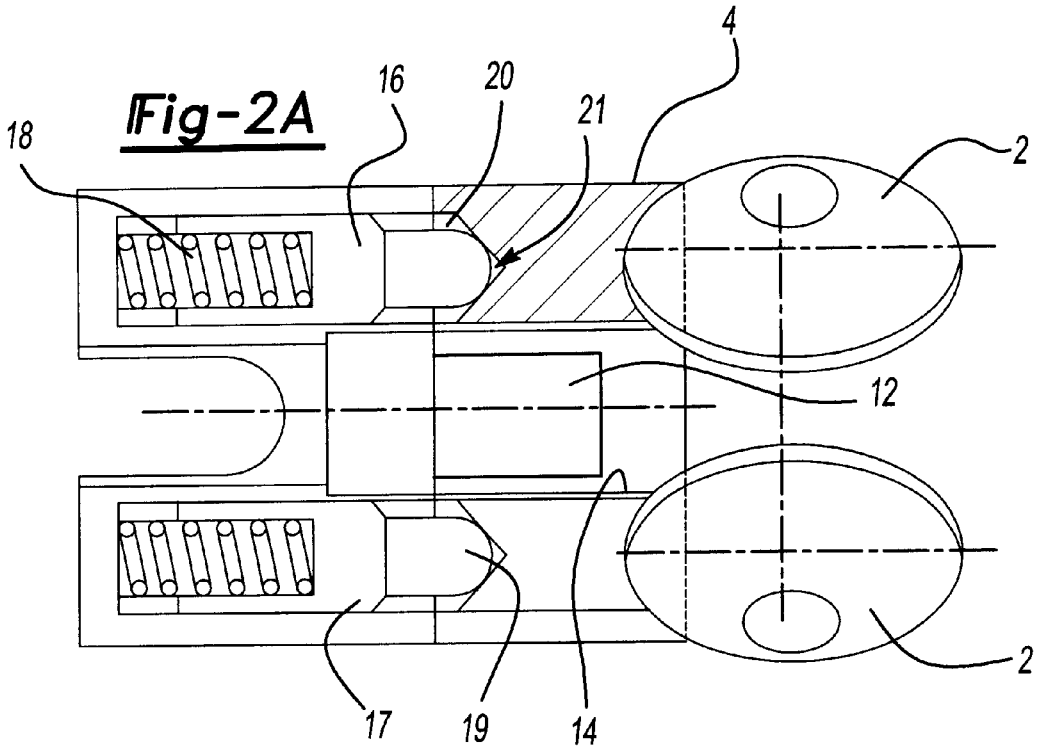
Figure 3:
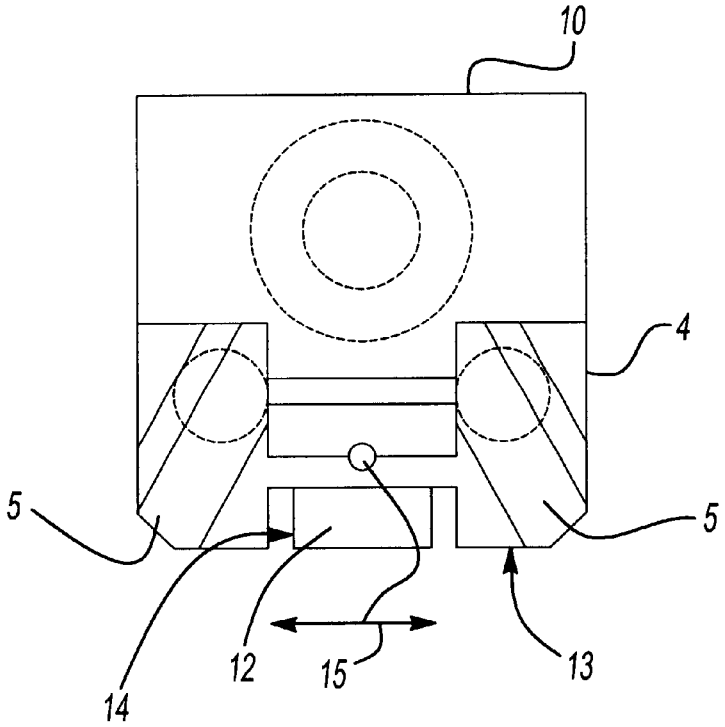

A tool 1 for the deep rolling of radii or grooves of crankshaft journals or crank pins (neither is shown) has, in addition to two work rollers 2, among other things two roller cages 3 and 4, where each of the work rollers 2 is guided using a portion of their circumference. The roller cage 4 which in the course of the description following will be examined on its own merits, is designed to guide the work roller 2 in a recess 5 provided on one of its faces 6. Using the rear face 7 located opposite the front face 6, the roller cage 4 is supported at the end 8 of the long leg 9 of an L-shaped tool holder 10.

In the direction of the double arrow 11 the roller cage 4 is free to move on the long leg 9, but its mobility is limited to a range of less than 1 mm, as long as the deep rolling tool is new. To this end the roller cage 4 is held by a tab 12 projecting from a long leg 9 at the end 8 of the long leg 9. For this purpose the roller cage 4 on its underside 13 features a longitudinal groove 14 in which the tab 12 is engaged. The longitudinal groove 14 is considerably wider then the tab 12, which provides the roller cage 4 with limited mobility in the direction of the double arrows 15, i.e., perpendicular to the extent of the long leg 9. The difference in width between the longitudinal groove 14 and the tab 12 is between 0.1 and 2.5 mm.

As can be clearly seen from the FIGS. 1*a* and 2*a*, two pins 16 and 17 are inserted in each end 8 of the long leg 9; each has a round cross-section and is elastically supported by a spring 18 providing it with flexibility in the axial direction 11. At their front ends the pins 16 and 17 each have a rounding 19 which engages in a recess 20 provided at the rear face 7 of the roller cage 4. This recess 20 is a simple blind hole whose inner end has the shape of a cone 21. Corresponding to the difference in width between the longitudinal groove 14 and the tab 12, the diameter of the recess 20 is between 0.1 and 2.5 mm larger than the diameter of the pins 16 and 17.

Cooperating with the spherical end 19 of the pins 16 and 17, the conical shape 21 of the recess 20 always causes the roller cage 4 to assume a middle, i.e., centered position viewed in the direction of its movement 15. From this position it will be deflected in the direction of the arrow 15 as soon as required by any manufacturing tolerances of the bearings of a crankshaft. Each deflection of the roller cage 4 in the direction of the double arrow 15 requires only a small force since the pins 16 and 17 are elastically supported within the end 8 of the L-shaped tool holder 10. The result of this flexibility is less wear of the roller cage 4 and the work rollers 2 caused by inaccuracies of the work.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the script of the appended claims the invention may be practiced otherwise than as specifically described.

What is claimed is:

1. A deep rolling tool for rolling the grooves on crankshaft journals comprising:

a tool holder having a first interlocking feature;

a first cage supported on said tool holder and having a second interlocking feature complimentary to and received by said first interlocking feature and defining a lateral clearance between said tool holder and said first cage to permit relative lateral movement there between, said first cage having a first recess;

a second cage having a second recess;

a work roller interposed between said cages and received by said recesses; and a biasing member coacting with said first cage to move said first cage towards said second cage while permitting said relative lateral movement between said first cage and said tool holder.

2. The tool according to claim 1, wherein said tool holder is L-shaped.

3. The tool according to claim 1, wherein said first cage includes an aperture opposite said first recess for receiving a portion of said biasing member.

4. The tool according to claim 3, wherein said biasing member includes a pin having a circular cross-section.

5. The tool according to claim 4, wherein said biasing member further includes a spring biasing said pin into said aperture.

6. The tool according to claim 3, wherein said tool includes a plurality of work rollers and a corresponding number of said biasing members.

7. The tool according to claim 4, wherein said pin includes a hemispherical end.

8. The tool according to claim 7, wherein said aperture includes a conical bottom for receiving said hemispherical end.

9. The tool according to claim 1, wherein said biasing member is received within a hole in said tool holder.

* * * * *